US007821191B2

(12) United States Patent
Takahashi et al.

(10) Patent No.: US 7,821,191 B2
(45) Date of Patent: Oct. 26, 2010

(54) FIELD EMISSION DISPLAY

(75) Inventors: Masanori Takahashi, Chigasaki (JP); Hiroaki Ibuki, Sagamihara (JP); Keiji Suzuki, Yokohama (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 271 days.

(21) Appl. No.: 11/961,704

(22) Filed: Dec. 20, 2007

(65) Prior Publication Data

US 2008/0174231 A1 Jul. 24, 2008

(30) Foreign Application Priority Data

Dec. 25, 2006 (JP) ..... 2006-348193

(51) Int. Cl.
*H01J 1/62* (2006.01)

(52) U.S. Cl. ..... 313/496

(58) Field of Classification Search ..... 313/496
See application file for complete search history.

(56) References Cited

U.S. PATENT DOCUMENTS

| | | | | |
|---|---|---|---|---|
| 5,592,056 | A * | 1/1997 | Peyre et al. | 313/496 |
| 5,670,296 | A * | 9/1997 | Tsai | 430/312 |
| 6,002,414 | A * | 12/1999 | Kobori et al. | 347/123 |
| 6,677,706 | B1 | 1/2004 | Hara et al. | 313/496 |
| 7,504,768 | B2 * | 3/2009 | Oh | 313/497 |
| 7,626,325 | B2 * | 12/2009 | Murata et al. | 313/496 |
| 2005/0179398 | A1 * | 8/2005 | Onishi | 315/169.2 |
| 2005/0276096 | A1 | 12/2005 | Hara et al. | 365/158 |
| 2006/0061258 | A1 * | 3/2006 | Tagawa et al. | 313/496 |
| 2006/0103294 | A1 * | 5/2006 | Suzuki et al. | 313/496 |
| 2006/0164001 | A1 | 7/2006 | Iba et al. | 313/495 |
| 2006/0170008 | A1 * | 8/2006 | Konishi | 257/236 |
| 2007/0241660 | A1 | 10/2007 | Suzuki et al. | 313/497 |
| 2009/0053962 | A1 * | 2/2009 | Oh | 445/24 |

FOREIGN PATENT DOCUMENTS

| | | |
|---|---|---|
| EP | 1 830 380 A1 | 9/2007 |
| JP | 10-326583 | 12/1998 |
| JP | 2006-185614 | 7/2006 |

* cited by examiner

*Primary Examiner*—Peter Macchiarolo
(74) *Attorney, Agent, or Firm*—Fitzpatrick, Cella, Harper & Scinto

(57) ABSTRACT

A display apparatus includes an electron source; a substrate; a light emitting body arranged on the substrate and emitting light by being irradiated by an electron emitted from the electron source; an anode disposed on the substrate and supplied with a voltage for accelerating the electron; and an electrode for supplying the voltage to the anode, the electrode being disposed along a side of the substrate, and the electrode has a plurality of electrode films, the electrode films including two electrode films adjacent to each other, and a resistor film connecting between the electrode films, and a length of the portion opposing the other electrode film in one electrode film from among the two electrode films is longer than a length of the one electrode film in a direction orthogonal to the longitudinal direction of the electrode.

9 Claims, 7 Drawing Sheets

FIELD EMISSION DISPLAY

BACKGROUND OF THE INVENTION

1. Field of the Invention

The present invention relates to display apparatuses.

2. Description of the Related Art

In recent years, in general, as a display apparatus having a vacuum envelope of a flat panel structure, there has been known a field emission display (FED) which uses emission from a light emitting body irradiated by electrons accelerated by the voltage applied to an anode. A display apparatus using a surface conduction electron-emitting device as an electron source is under development.

Japanese Patent Application Laid-Open No. H10-326583 discloses a configuration in which an anode is applied with a high voltage via a common electrode.

Japanese Patent Application Laid-Open No. 2006-185614 also discloses a configuration in which an anode is applied with a high voltage via a common electrode.

Particularly, Japanese Patent Application Laid-Open No. 2006-185614 discloses a configuration in which the common electrode is electrically segmentalized into a plurality of areas.

SUMMARY OF THE INVENTION

FIG. 11 shows a configuration of a common electrode 120 disclosed by Japanese Patent Application Laid-Open No. 2006-185614.

The common electrode 120 is annularly provided so as to surround the periphery of a metal back 114, and is connected to an edge portion of the metal back 114 via a resistor film 122 (resistor member). In other words, the common electrode 120 has a plurality of electrode films 124 (conductive members) spaced-apart in the longitudinal direction, and is provided with a resistor film 122 annularly superposed on the electrode films 124 so as to annularly connect the electrode films 124, and the inner periphery of the resistor film 122 is connected to the edge portion of the metal back 114. The electrode film 124 is, for example, formed by patterning of a silver paste.

While the common electrode preferably has a resistance of some degree, when the resistance is too low, this leads to the occurrence of a voltage distribution. Although the resistance of the entire common electrodes can be prevented from becoming too large by narrowing an interval between the adjacent electrode films, when the interval between the electrode films is narrow, the possibility of an electric discharge occurring between the electrode films looms large.

An object of the present invention is to realize a configuration capable of suitably setting a resistance of the electrode supplying a voltage to an anode, while suppressing the electric discharge between the electrode films in the configuration in which the electrode supplying the voltage to the anode has a plurality of electrode films.

The display apparatus of the present invention includes an electron source; a substrate; a light emitting body arranged on the substrate and emitting light by being irradiated by an electron emitted from the electron source; an anode disposed on the substrate and supplied with a voltage for accelerating the electron; and an electrode for supplying the voltage to the anode, the electrode being disposed along a side of the substrate, wherein the electrode has a plurality of electrode films and a resistor film connecting between the electrodes, and the plurality of electrode films include two electrode films adjacent to each other, and a length of the portion opposing the other electrode film in one electrode film from among the two electrode films is longer than a length of the one electrode film in a direction orthogonal to the longitudinal direction of the electrode.

According to the present invention, in the configuration in which the electrode supplying the voltage to the anode has a plurality of electrode films, the electric discharge between the electrode films is suppressed, while the resistance of the electrode supplying the voltage to the anode can be suitably set.

Further features of the present invention will become apparent from the following description of exemplary embodiments with reference to the attached drawings.

DESCRIPTION OF THE EMBODIMENTS

Embodiments of the present invention will be described with reference to the drawings.

Figure 1:
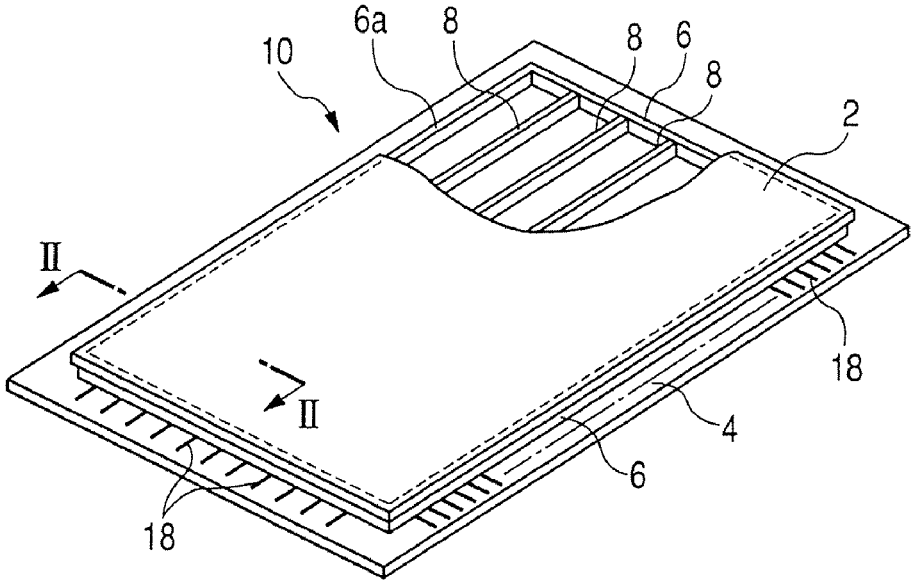
FIG. 1 is an oblique view showing a vacuum envelope of an SED in a state in which a front substrate is partially cut out.
Figure 2:
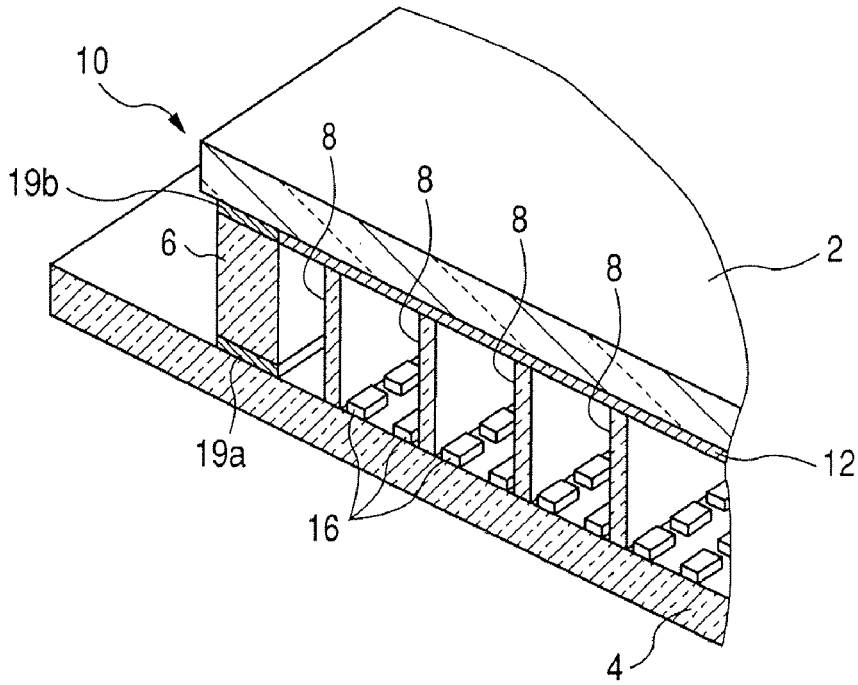
FIG. 2 is a cross-sectional view cut along the line II-II of the vacuum envelope of FIG. 1.
Figure 3:
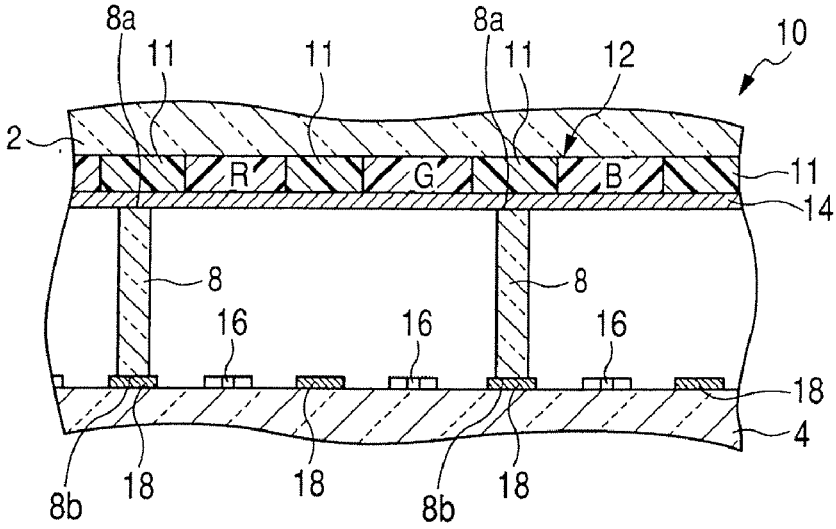
FIG. 3 is a partially enlarged cross-sectional view partially enlarging the cross-section of FIG. 2.

First, referring to FIGS. 1 to 3, as one example of a display apparatus according to the embodiments of the present invention, a display apparatus using a surface conduction electron-emitting device will be described. FIG. 1 is an oblique view showing a vacuum envelope 10 (hereinafter sometimes referred to as a display panel 10) of the display apparatus in a state in which a front substrate 2 is partially cut out. FIG. 2 is a cross-sectional view cut along the line II-II of the vacuum envelope 10 of FIG. 1. FIG. 3 is a partially enlarged cross-sectional view partially enlarging the cross-section of FIG. 2.

As shown in FIGS. 1 to 3, the display panel 10 includes a front substrate 2 (equivalent to the substrate of the present invention) and a rear substrate 4 having a rectangular glass plate, respectively. These substrates are oppositely disposed to each other in parallel at the intervals of approximately 1.0 to 2.0 mm. The rear substrate 4 has a size slightly larger than the front substrate 2. The front substrate 2 and the rear substrate 4 are connected to each other at peripheral edge portions via a side wall 6 made of glass in the shape of a rectangular frame, and form a vacuum envelope of a flat panel structure whose interior is vacuum.

The inner surface of the front substrate 2 is formed with a phosphor screen 12 working as an image display surface. This phosphor screen 12 is formed by laying phosphor layers R, G, and B, and a light shielding layer 11 side by side, and superposed with a metal back 14 (equivalent to the anode of the present invention) made of aluminum and the like. The phosphor layers R, G, and B are formed in the shape of a stripe or a dot.

The inner surface of the rear substrate 4 is provided with a number of surface conduction electron-emitting devices 16 which emit electron beams for allowing the phosphor layers R, G, and B of the phosphor screen 12 to perform excited emission. These electron-emitting devices 16 are disposed in a plurality of rows and a plurality of columns corresponding to each pixel, that is, each of the phosphor layers R, G, and B. Each electron-emitting device 16 includes an unillustrated electron emitting portion and a pair of device electrodes and the like which apply a voltage to this electron emitting portion. On the inner surface of the rear substrate 4, a number of wirings 18 for giving a drive voltage to each electron-emitting device 16 are provided in a matrix pattern, and the end portion thereof is pulled out to the outside of the vacuum envelope 10.

The rear substrate 4, the electron-emitting device 16, and the wiring 18 form an electron source.

The side wall 6 working as a junction member, for example, is sealed on the peripheral edge portion of the front substrate 2 and the peripheral edge portion of the rear substrate 4 by a sealing material 19 such as a low melting point glass and a low melting point metal, and joins these substrates to each other. In the present embodiment, the rear substrate 4 and the side wall 6 are joined by using a frit glass 19*a*, and the front substrate 2 and the side wall 6 are joined by using indium 19*b*.

The display panel 10 includes a plurality of slender plate-like spacers 8 having glass between the front substrate 2 and the rear substrate 4. In the present embodiment, though the spacers 8 are taken as a plurality of slender glass plates, a number of columnar spacers may be used.

Each spacer 8 has an upper end 8*a* abutting on the inner surface of the front substrate 2 via the metal back 14 of the phosphor screen 12 and the light shielding layer 11, and a lower end 8*b* abutting on the wiring 18 provided on the inner surface of the rear substrate 4. These spacers 8 support atmospheric load acting from the outside of the front substrate 2 and the rear substrate 4, and maintain the interval between the substrates at a predetermined value.

The display apparatus in this embodiment includes an unillustrated voltage supply portion to apply an anode voltage to the metal back 14 of the front substrate 2. The voltage supply portion, for example, applies a high voltage to the extent of 10 kV to the metal back 14, thereby increasing the voltage of the phosphor screen 12. As a result, between the earthed rear substrate 4 and the front substrate 2, a difference of voltages to the extent of 10 kV is formed.

When an image is to be displayed in the SED, a voltage is given between device electrodes of the electron-emitting device 16 via an unillustrated drive circuit connected to the wiring 18, and electron beams are emitted from the electron-emitting portion of any of the electron-emitting devices 16, and at the same time, an anode voltage is applied to the metal back 14. The electron beams emitted from the electron-emitting portion are accelerated by the anode voltage, and are irradiated on the phosphor screen 12. As a result, the phosphor layers R, G, and B of the phosphor screen 12 are excited to emit, thereby displaying a color image.

When the display panel 10 of the above described structure is to be fabricated, the front substrate 2 provided with the phosphor screen 12 is prepared in advance, and the rear substrate 4 provided with the electron-emitting device 16 and the wiring 18 as well as joined with the side wall 6 and the spacer 8 is prepared. The front substrate 2 and the rear substrate 4 are disposed inside an unillustrated vacuum chamber, and after the interior of the vacuum chamber is vacuum-evacuated, the front substrate 2 is joined to the rear substrate 4 via the side wall 6.

Meantime, the display apparatus of the above described structure has the front substrate 2 and the rear substrate 4 opposed to each other via a minute gap to the extent of 1 to 2 mm, thereby maintaining the interior thereof at a super-high vacuum. Hence, for example, when a foreign matter such as a thin film fragment is applied to the wiring 18 and the electron-emitting device 16, it is known that an electrical discharge occurs between the substrates 2 and 4 with that foreign matter as a base point. At this time, when the metal back 14 is formed across the entire surface of the front substrate 2, almost all the electric charges charged in the metal back 14 are concentrated on the discharging place so as to let an excessive discharge current flow, and as a result, the electron-emitting device 16 may be destroyed.

By adopting a configuration in which the anode is allowed to have some resistance, the current flowing at the time of the electric discharge can be suppressed. As a configuration for increasing the resistance of the anode, a configuration can be suitably adopted in which the anode is formed by a plurality of electrodes, and a resistor is connected between these electrodes. For example, the metal back 14 is configured to be a form electrically segmentalized into a plurality of areas, so that the electric charge can be prevented from concentratedly flowing into one place when an electric discharge occurs between the substrates. In the configuration in which the anode is allowed to have some degree of resistance in this manner, when the anode is configured to be supplied with the anode voltage at one place only of the anode, a voltage distribution occurs inside the anode due to the resistance of the anode. This voltage distribution can be prevented from occurring inside the anode by providing a common electrode (equivalent to the electrode of the present invention) along a side of the front substrate and supplying the voltage to the anode from the common electrode at a plurality of positions. However, when the electric discharge occurs close to the connection portion between the common electrode for applying the anode voltage to the metal back 14 segmentalized into the plurality of areas and the edge portion of the metal back 14, a problem arises that the electric discharge current flows into the edge portion of the metal back 14 via the resistor member connecting both of the common electrode and the metal back 14 so as to increase the electric discharge current. This problem can be improved by forming the common electrode by a plurality of electrode films and the resistor film connecting between the electrode films. This is because the current flowing from the common electrode can be limited. However, since the common electrode is provided in order to suppress the voltage distribution inside the anode surface, when the resistance value becomes too large, this creates a problem. Thus, when an attempt is made to narrow the interval between the electrode films, the possibility of the electric discharge occurring between the electrode films looms large. To solve this problem, the present embodiment has configured the common electrode as follows.

First Embodiment

Figure 4A:
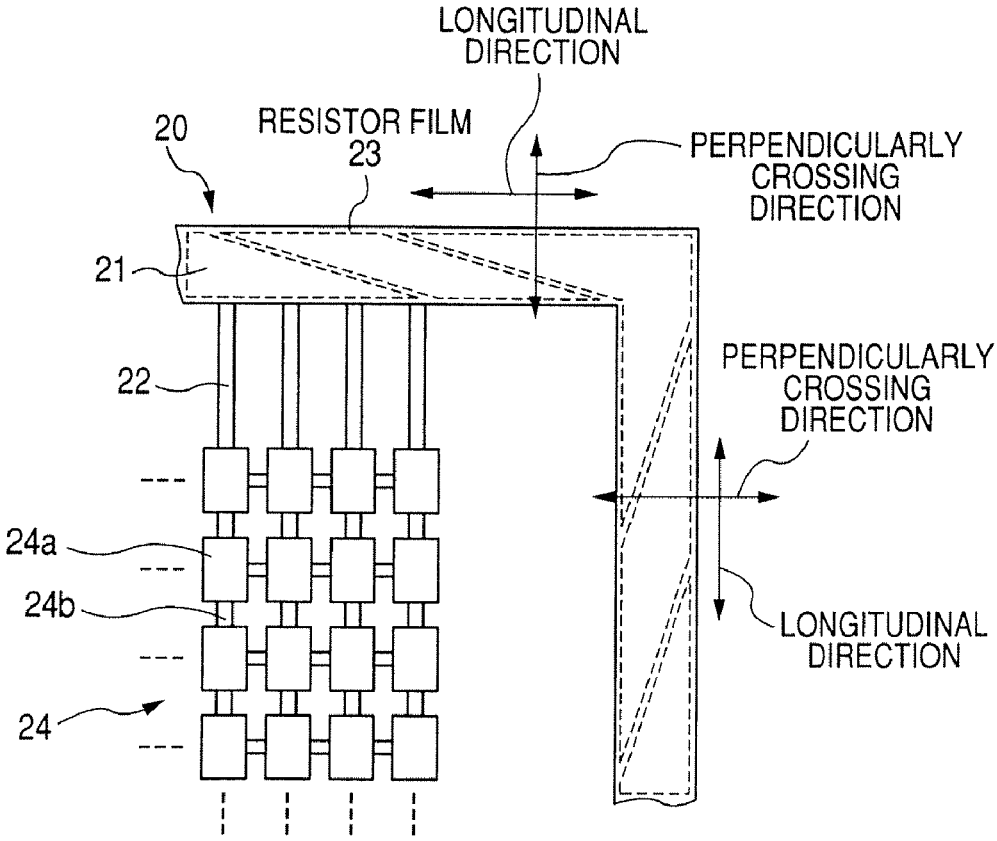
FIG. 4A is a schematic diagram partially and enlargedly showing the structures of a metal back and a common electrode provided in the inner surface of a front substrate in a first embodiment of the present invention.

FIG. 4A is a schematic diagram partially and enlargedly showing the structures of a metal back and a common electrode provided in the inner surface of a front substrate in a first embodiment of the present invention.

As shown in FIG. 4A, a metal back 24 of the present embodiment is segmentalized into a plurality of rectangular island-shaped areas 24*a*. More specifically, for example, the rectangular island-shaped areas 24*a* to cover phosphor layers R, G, and B not illustrated here on a one-to-one correspondence are formed in a matrix pattern, and each segmentalized area 24*a* is electrically connected via a resistor member 24*b*.

On the other hand, a common electrode 20 is annularly provided so as to surround the periphery of the metal back 24. The common electrode 20 includes a plurality of electrode films 21 spaced-apart in its longitudinal direction, and a resistor film 23 is annularly provided superposed on the electrode films 21 so as to annularly connect the electrode films 21. The resistor film 23 of the common electrode 20 is connected to the edge portion of the metal back 24 via a resistor film 22. The electrode film 21, for example, is formed by patterning of a silver paste. The electrode film referred to in the present invention means a portion having a sheet resistor value of 1Ω/ or less. The resistor film means a portion having a resistor value larger than 1Ω/.

Figure 4B:
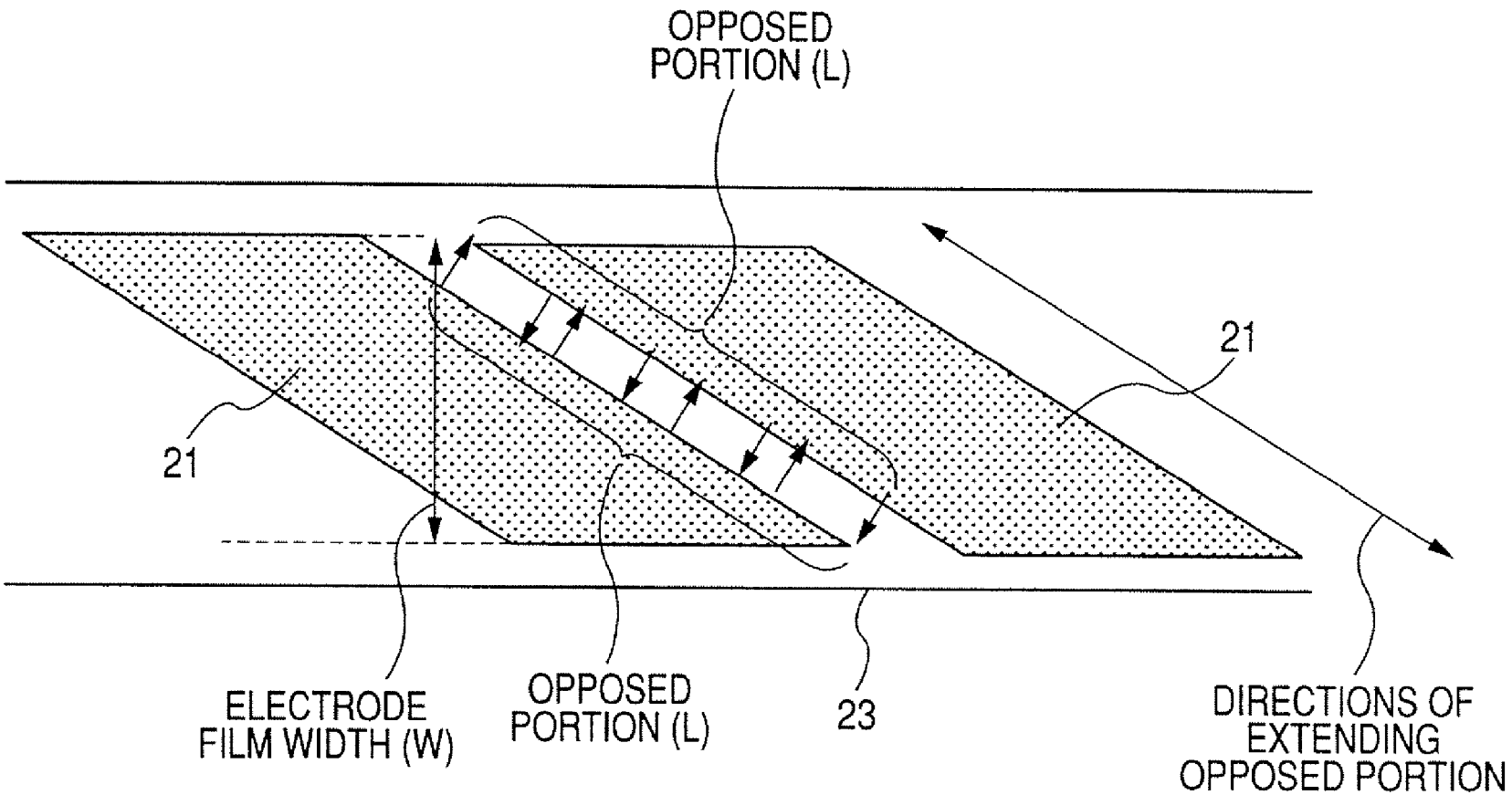
FIG. 4B is a view enlargedly showing the resistor film and two adjacent electrode films shown in FIG. 4A.
Figure 11:
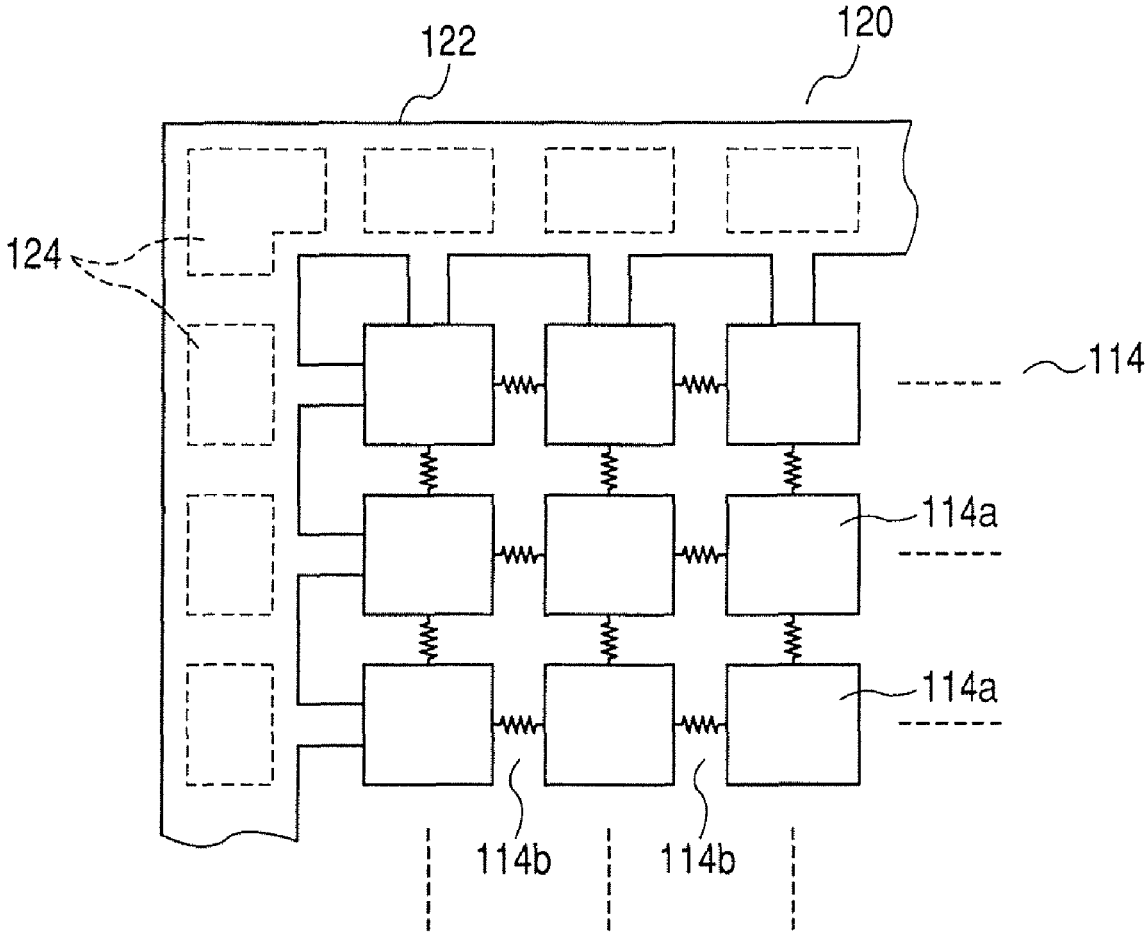
FIG. 11 is a schematic diagram partially and enlargedly showing the structures of the metal back and the common electrode provided in the inner surface of the front substrate in the conventional art.

The common electrode is formed by the electrode films 21 disposed at intervals, so that the electric resistance of the common electrode 20 can be increased as compared with the case where the electrode films 21 are annularly connected. In the present embodiment, the extending direction of the sides opposed to each other of each electrode film 21 is oblique to the longitudinal direction of the common electrode 20. Here, the portion opposing the adjacent electrode films is a set of the portions satisfying a relationship where, when a normal line is taken toward the outside of the electrode film in each portion of the contour of one electrode, the normal line intersects the other electrode film. FIG. 4A shows a longitudinal direction of the common electrode and a direction (width direction) orthogonal to the longitudinal direction. In this embodiment, since the common electrodes are provided along a plurality of sides of the substrate, the longitudinal direction of the common electrode is determined corresponding to each side, respectively. FIG. 4B shows two electrode films adjacent to the resistor film. FIG. 4B also illustrates the normal line (illustrated by an arrow) in each of plural portions of the contour of the electrode film. A length L of this opposing portion is larger than the largest width W of the electrode film (the largest width of the electrode film is the largest among the lengths of the electrode films in the direction orthogonal to the longitudinal direction of the common electrode). The extending direction of the opposed portion is in non-parallel with the direction orthogonal to the longitudinal direction of the electrode. The opposing portions of the electrode film are allowed to satisfy the above described requirement, so that, even when the interval (interval at the opposed portion) between the adjacent electrode films is large to some extent, the resistance of the entire electrode can be suppressed. However, when the interval between the adjacent electrode films (the interval between the adjacent electrode films is taken as an average value of the interval in the direction of the normal line at the opposed portion) is too large, the resistance as the entire electrode ends up becoming large. Hence, the interval between the adjacent electrode films is preferably 1 mm or less. On the other hand, the length of the opposed portion of an electrode film 124 of the conventional art shown in FIG. 11 is the same as the width of the electrode film. When the sheet resistance value of the resistor film 23 is taken as ρ(Ω/), the interval between adjacent electrode films as G, and the length of the opposed portion in the adjacent electrodes as L, the resistance value between the opposed portions is ρ×G/L. In the present embodiment, when G is assumed to be the same as in the configuration of FIG. 11, the L in the present embodiment is larger than the L in FIG. 11, and therefore, the resistance value between the adjacent electrode films can be suppressed.

Second Embodiment

Figure 5:
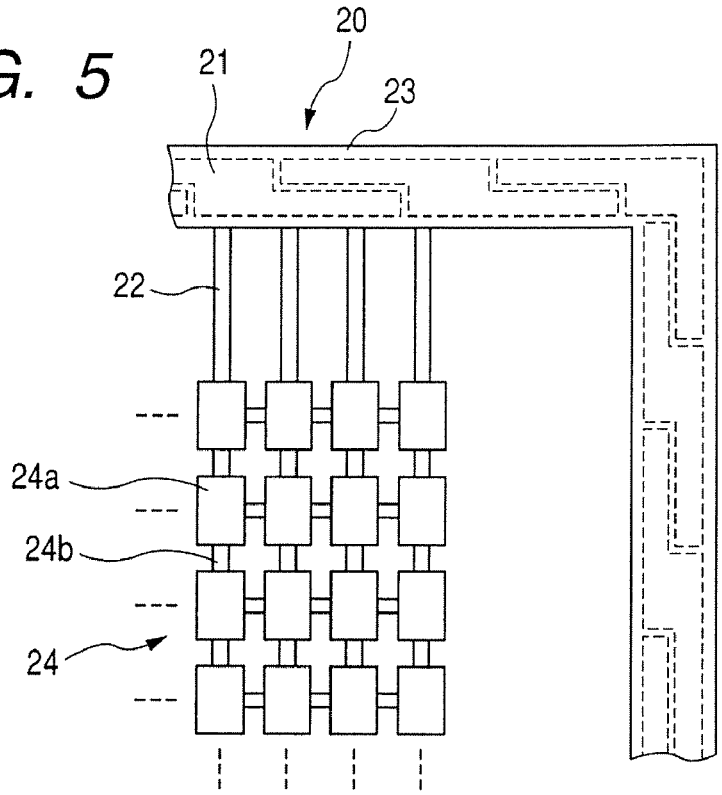
FIG. 5 is a schematic diagram partially and enlargedly showing the structures of the metal back and the common electrode provided in the inner surface of the front substrate in a second embodiment of the present invention.

FIG. 5 is a schematic diagram partially and enlargedly showing the structures of a metal back and a common electrode provided in the inner surface of a front substrate in a second embodiment of the present invention.

In the present embodiment also, a common electrode 20 is annularly provided so as to surround the periphery of the metal back 24. The common electrode 20 includes a plurality of electrode films 21 spaced-apart in its longitudinal direction, and a resistor film 23 is annularly provided superposed on the electrode films 21 so as to annularly connect the electrode films 21. The resistor film 23 of the common electrode 20 is connected to the edge portion of the metal back 24 via the resistor film 22.

In the present embodiment, the portion opposed to each other of each electrode film 21 has a portion extended to the longitudinal direction of the common electrode 20 and a portion extended in the width direction of the common electrode 20 orthogonal to the longitudinal direction of the common electrode 20. Hence, the length of the opposed portion of the electrode film 21 in the present embodiment is longer than the length of the opposed portion of the electrode film of the conventional art shown in FIG. 11.

In this manner, in the present embodiment also, while the interval between the segmentalized electrode films 21 is secured so as to suppress an electric discharge between the electrode films 21, the entire resistance of the common electrode 20 can be prevented from becoming large.

Figure 6:
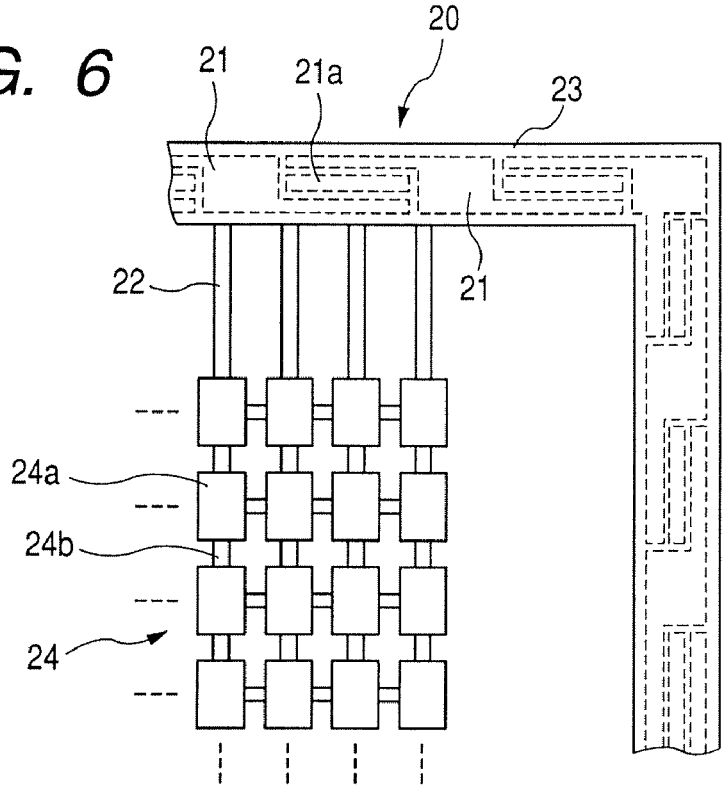
FIG. 6 is a view showing a modified example of the embodiment shown in FIG. 5.

FIG. 6 is a view showing a modified example of the embodiment shown in FIG. 5.

In this modified example also, similarly to the embodiment shown in FIG. 5, the portion opposed to each other of each electrode film 21 and 21*a* has an extended portion in the longitudinal direction of the common electrode 20 and an extended portion in the width direction of the common electrode 20. In the present modified example, the electrode film 21*a* is disposed so as to be surrounded between two electrode films 21.

Even by this configuration, the gap between the segmentalized electrode films 21 and 21*a* is maintained so as to suppress the electric discharge between the electrode films, while enabling to prevent the entire resistance of the common electrode 20 from becoming large.

Third Embodiment

Figure 7:
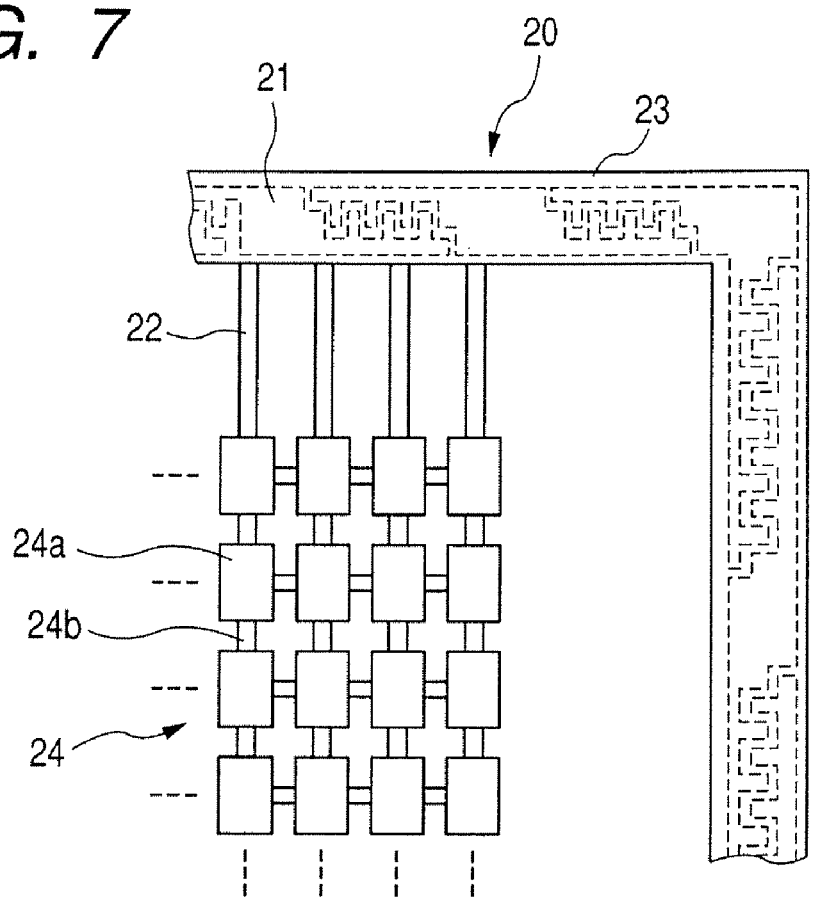
FIG. 7 is a schematic diagram partially and enlargedly showing the structures of the metal back and the common electrode provided in the inner surface of the front substrate in a third embodiment of the present invention.

FIG. 7 is a schematic diagram partially and enlargedly showing the structures of a metal back and a common electrode provided in the inner surface of a front substrate in a third embodiment of the present invention.

In the present embodiment also, a common electrode 20 is annularly provided so as to surround the periphery of the metal back 24. The common electrode 20 includes a plurality of electrode films 21 spaced-apart in its longitudinal direction, and a resistor film 23 is annularly provided superposed on the electrode films 21 so as to annularly connect the electrode films 21. The resistor film 23 of the common electrode 20 is connected to the edge portion of the metal back 24 via the resistor film 22.

In the present embodiment, the portion opposed to each other of each electrode film 21 has a portion extended to the longitudinal direction of the common electrode 20 and a portion extended in the width direction of the common electrode 20, and has a comb teeth engagement shape. Hence, the length of the opposed portion of the electrode film 21 in the present embodiment is longer than the length of the above described embodiment.

In this manner, in the present embodiment also, while the interval between the segmentalized electrode films 21 is secured so as to suppress an electric discharge between the electrode films 21, enabling to prevent the entire resistance of the common electrode 20 from becoming large.

In each of the above described embodiments, the resistor film 22 connecting the common electrode 20 and the metal back 24, and the resistor film 23 connecting each electrode film 21 of the common electrode 20 to each other may be different or the same in resistance. When the resistance values of the resistor films 22 and 23 are to be made different, for example, the resistor film 22 can be made of $TiO_2$ based material of $1\times10^5\Omega/$ in sheet resistance, and the resistor film 23 can be made of ITO (indium oxide tin) based material of $1\times10^4\Omega/$ in sheet resistance. When the resistance values of the resistor films 22 and 23 are to be made the same, for example, the resistor films 22 and 23 can be made of $TiO_2$ based material of $1\times10^5\Omega/$ in sheet resistance.

As described above, in the configuration where the sheet resistance value of the resistor film 23 in the common electrode is lower than the sheet resistance value of the resistor film 22 connecting the common electrode and the anode, the interval between the adjacent electrode films can be made larger comparing with the case where the sheet resistance value of the resistor film 23 is made the same as the sheet resistance value of the resistor film 22.

EXAMPLE

Here, a method for manufacturing the structures of the metal back and the common electrode shown in FIG. 7 will be specifically described with reference to FIGS. 8 and 9.

When a high-definition complicated pattern as shown in FIG. 7 is to be printed, photolithography can be suitably used. However, Ag paste for photolithography is expensive. The manufacturing method described below enables to print the pattern shown in FIG. 7 with high precision by using a relatively low-priced Ag paste for screen printing.

Figure 8A:
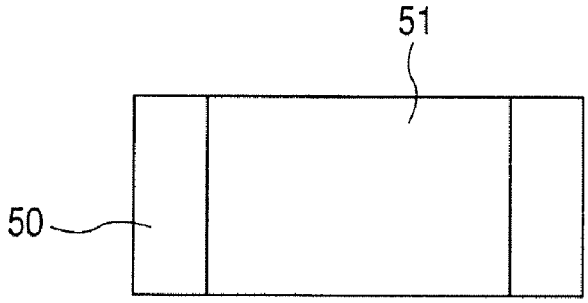
FIGS. 8A and 8B are views showing a method for manufacturing the structures of the metal back and the common electrode shown in FIG. 7.

FIG. 8A shows a first layer common electrode base 51 formed on a black matrix 50 of the front substrate. The common electrode base 51 is formed by the screen printing by using $TiO_2$ based resistor material so as to be wider in width than the width of the electrode film 21.

Figure 8B:
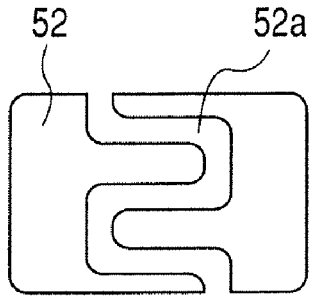

FIG. 8B shows a second layer common electrode base 52 formed on the first layer common electrode base 51. The common electrode base 52 is formed by the photolithography by using the same resistor material as the first layer common electrode base 51 so that a groove 52*a* equivalent to the gap between the electrode films 21 of the common electrode 20 is formed. This groove 52*a* is formed by the photolithography, and therefore, has sufficient accuracy to form a gap.

Figure 9A:
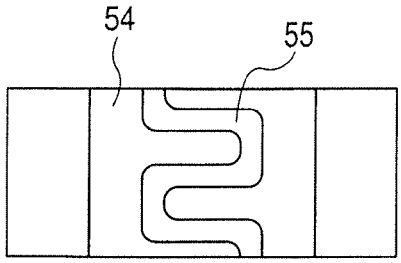
FIGS. 9A, 9B and 9C are views showing a method for manufacturing the structures of the metal back and the common electrode shown in FIG. 7.
Figure 9B:
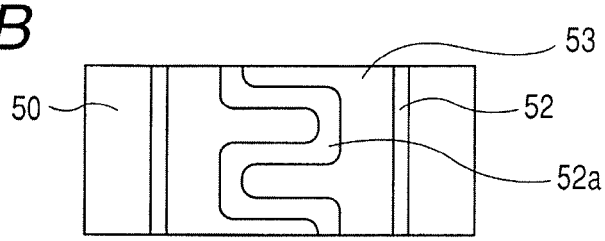
Figure 9C:
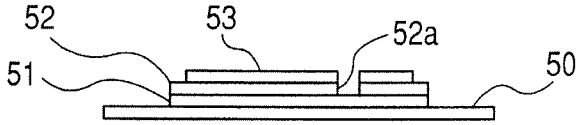

On the surface of the second layer common electrode base 52 thus formed, a conductive paste 53 is printed by using a screen. Here, when a printing plate of the mesh pattern having the same width as the common electrode 20 is simply used, the bottom of the groove 52*a* of the second layer common electrode base 52 ends up being also applied with the conductive paste 53, and a desired resistance value between the electrode films 21 cannot be obtained. In contrast to this, in the present embodiment, as shown in FIG. 9A, the printing of the conductive paste 53 is performed by using a printing plate having a pattern in which an emulsion 55 is formed corresponding to the groove 52*a* of the second common electrode base 52 in the mesh 9 having the width of the common electrode 20. The width of the emulsion 55 of the portion corresponding to this groove 52*a* is formed thinner than the groove 52*a* in consideration of the fluctuation of accuracy of the printing plate itself and positional fluctuation at the printing time. By using such printing plate, as shown in FIG. 9B, the conductive paste 53 is prevented from entering inside the groove 52*a*, and the cross-sectional structure as shown in FIG. 9C is formed.

The above described manufacturing method enables to print the pattern shown in FIG. 7 in this manner with high precision even when the relatively low-priced Ag paste for screen printing is used.

Figure 10:
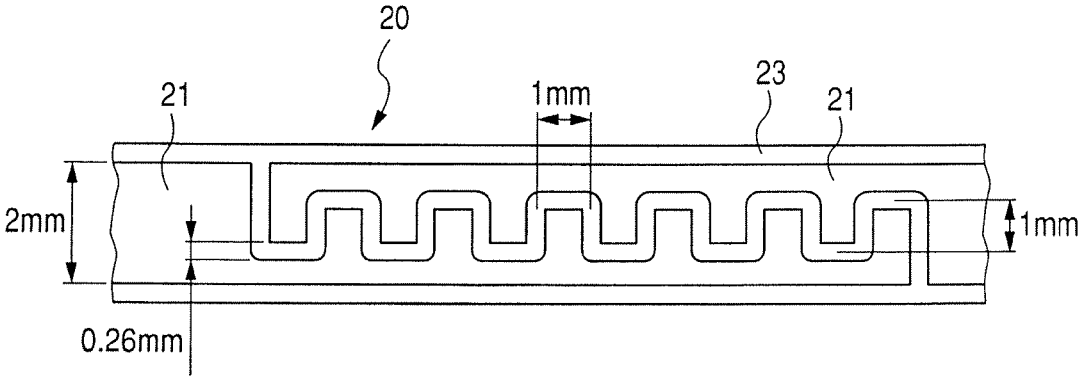
FIG. 10 is a view showing a specific size of the common electrode shown in FIG. 7.

FIG. 10 is a view showing a specific size of the common electrode 20 shown in FIG. 7. The width of the electrode film 21 is 2 mm, and the interval G of the opposing portion of the electrode film 21 is 0.26 mm. The length of one tooth portion of the comb teeth shape electrode film 21 is 1 mm for both length and breadth. The total length L of the opposing portion of the electrode film 21 is 26 mm or more. The sheet resistance ρ of the resistor film 23 formed by the common electrode base 51 is $2\times10^5\Omega/$.

At this time, an aspect ratio of the segmentalized portion of the electrode film 21 (the gap of the segmentalized portion/the length of the segmentalized portion) is smaller than 0.26/26=0.01. The resistance value of the resistor film 23 between two electrode films 21 is ρ×G/L, and therefore, in the configuration shown in FIG. 7 having a value larger than 2 kΩ, such opposing portions are provided 20 places in the common electrode 20 of a long side of the front substrate, and 15 places in the common electrode 20 of the short side. As a result, the resistance of the common electrode 20 at the long side is 40 kΩ or more per one side, and the resistance of the common electrode 20 at the short side is 30 kΩ or more per one side. By obtaining such resistance value, the lower luminance due to the voltage drop at the driving time of the common electrode 20 is suppressed within three percent, while enabling to suppress the discharge current.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-348193, filed Dec. 25, 2006, which is hereby incorporated by reference herein in its entirety.

What is claimed is:

1. A field emission display comprising:

an electron source;

a substrate;

a phosphor layer arranged on the substrate, and emitting light by irradiation with an electron emitted from the electron source;

a metal back disposed on the substrate and supplied with a voltage for accelerating the electron; and a common electrode disposed on the substrate for supplying the voltage to the metal back, wherein the common electrode includes one and other electrode films disposed apart in a longitudinal direction of the common electrode, and includes a resistor film, wherein the one electrode film has an opposed portion opposing to the other electrode film, which is a part of a contour of the one electrode film, and the other electrode film has an opposed portion opposing to the one electrode film, which is a part of a contour of the other electrode film, and the resistor film connects the opposed portion of the one electrode films and the opposed portion of the other electrode film, and wherein a length of the opposed portion of the one electrode film is longer than a length of the one electrode film in a direction orthogonal to the longitudinal direction and a length of the opposed portion of the other electrode film is longer than a length of the other electrode film in the direction orthogonal to the longitudinal direction.

2. The field emission display according to claim 1, wherein the opposed portion of the one electrode film is not parallel with the direction orthogonal to the longitudinal direction.

3. The field emission display according to claim 1, wherein the opposed portion of the one electrode film includes a portion extending in the longitudinal direction and a portion extending in the direction orthogonal to the longitudinal direction.

4. The field emission display according to claim 3, wherein the opposed portions of the one and the other electrode films are formed into comb teeth engagement shape.

5. The field emission display according to claim 1, wherein the common electrode is disposed so as to surround a periphery of the metal back.

6. The field emission display according to claim 1, wherein the metal back comprises a plurality of metal-back-segments, and the plurality of metal-back-segments are electrically connected to each other via a resistor.

7. The field emission display according to claim 1, wherein the metal back and the common electrode are connected via a plurality of resistive members, and the plurality of resistive members are respectively connected at each of a plurality of positions of the common electrode in a longitudinal direction and at each of a plurality of positions of the metal back.

8. The field emission display according to claim 7 wherein a sheet resistance value of the resistor film is lower than a sheet resistance value of the resistive member.

9. The field emission display according to claim 1, wherein the one and the other electrode films are disposed on the substrate and the resistor film is superposed on the one and other electrode films, or the resistor film is disposed on the substrate and the one and other electrode films are disposed on the resistor film.

* * * * *